US006843002B1

(12) United States Patent
Moffitt

(10) Patent No.: US 6,843,002 B1
(45) Date of Patent: Jan. 18, 2005

(54) BLADE ATTACHMENT FOR AN ALL-TERRAIN VEHICLE

(75) Inventor: Chadron D. Moffitt, Spirit Lake, IA (US)

(73) Assignee: Cycle Country Accessories Corporation, Milford, IA (US)

( * ) Notice: Subject to any disclaimer, the term of this patent is extended or adjusted under 35 U.S.C. 154(b) by 0 days.

(21) Appl. No.: 10/621,738

(22) Filed: Jul. 17, 2003

(51) Int. Cl.[7] ..... E01H 5/04

(52) U.S. Cl. ..... 37/231; 37/232; 37/235; 37/266; 37/381; 172/272; 172/817; 172/818

(58) Field of Search ..... 172/777–779, 172/272, 810, 811, 815, 817–831; 37/214–218, 231–233, 235, 236, 753, 381, 266–283, 407–410, 903

(56) References Cited

U.S. PATENT DOCUMENTS

| | | | | |
|---|---|---|---|---|
| 2,171,830 A | | 9/1939 | Hayes | 97/47 |
| 2,228,490 A | | 1/1941 | Smith | 97/47 |
| 2,426,410 A | | 8/1947 | Owen | 37/42 |
| 3,012,345 A | | 12/1961 | Krueger | 37/42 |
| 3,881,261 A | | 5/1975 | Lavoie | 37/46 |
| 3,898,753 A | | 8/1975 | Kinnunen | 37/46 |
| 4,615,130 A | | 10/1986 | Racicot | 37/231 |
| 4,962,598 A | * | 10/1990 | Woolhiser et al. | 37/231 |
| 5,081,775 A | | 1/1992 | Veilleux | 37/197 |
| 5,088,215 A | | 2/1992 | Ciula | 37/197 |
| 5,615,745 A | | 4/1997 | Cross | 172/811 |
| RE37,628 E | | 4/2002 | Segorski et al. | 37/231 |
| 6,502,334 B1 | | 1/2003 | Davies | 37/231 |

* cited by examiner

*Primary Examiner*—Christopher J. Novosad
(74) *Attorney, Agent, or Firm*—Thomte, Mazour & Niebergall; Dennis L. Thomte

(57) ABSTRACT

A blade attachment for an off-road vehicle such as an ATV is provided. A mounting frame is pivotally connected at its rearward end to the ATV rearwardly of the forward end thereof. A hinge plate is pivotally mounted, about a vertical axis, to the forward end of the mounting frame and has the blade of this invention mounted thereon to enable the blade to be pivoted left, right, or positioned in a straight position. The blade is locked in its various positions by a blade position lever. A linkage is mounted on the forward end of the push tube assembly which is operatively connected to the blade position lever for moving the blade position lever between its locked and unlocked positions. The blade position lever is automatically moved to its unlocked position upon the linkage engaging the underside of the ATV. A winch is operatively connected, in a slip clutch fashion, to the hinge plate to enable the blade to be pivotally moved, about a vertical axis, between its various angular positions, when the blade position lever is in its unlocked position through the linkages.

33 Claims, 9 Drawing Sheets

BLADE ATTACHMENT FOR AN ALL-TERRAIN VEHICLE

BACKGROUND OF THE INVENTION

1. Field of the Invention

This invention relates to a blade attachment for an off-road vehicle such as an all-terrain vehicle (ATV) and more particularly to a blade attachment for an ATV wherein the angle of the blade may be conveniently selectively changed by means of an electric motor driven winch which is powered by the ATV electrical system.

2. Description of the Related Art

The assignee of this invention has manufactured straight and V-blades for ATVs for many years. The blades may be used to plow snow, dirt, etc. The prior art blades have been raised and lowered with respect to the ATV by lift handles, electric actuators, electric winches, etc. In assignee's prior art straight blade, the blade is selectively pivotally attached, about a vertical axis, to the forward end of a push tube assembly which is pivotally connected at its rearward end, about a horizontal axis, to the ATV. The blade is pivotally connected to the push tube assembly so that the blade may be angled left, angled right or positioned in a straight position. When the operator of the ATV desires to change the angle of the blade, the blade must be raised from the ground with the operator then being required to dismount the ATV, unlock the blade, manually pivotally move the blade to the desired position, and then lock the blade in that position. Similar prior art structures have also been used by other manufacturers of blade attachments for ATVs. Various types of pivoting blade attachments are illustrated in U.S. Pat. Nos. 5,088,215; 4,615,130; and RE37,628. In each of the blades of the previously identified patents, the operator must leave the ATV and remove or move a locking pin, manually pivot the blade to the desired position, and then move the locking pin to its locked position.

The requirement of the operator to dismount from the ATV and make the blade adjustment is inconvenient in those plowing or grading operations where the angle of the blade on the ATV must be frequently changed.

SUMMARY OF THE INVENTION

A blade attachment for an off-road vehicle such as an all-terrain vehicle (ATV) is described with the ATV having a forward end, a rearward end, a right side, a left side, and an underside. A mounting frame or push tube assembly is positioned beneath the forward end of the ATV and has its rearward end pivotally connected, about a horizontal axis, to the ATV. The mounting frame extends forwardly from its rearward end so that its forward end is positioned forwardly of the forward end of the ATV. The forward end of the mounting frame is selectively movable between raised and lowered positions by any conventional means such as a lift handle, winch, linear actuator, etc. A first plate is secured to the forward end of the mounting frame and has a hinge plate selectively pivotally movably positioned thereon about a vertical axis with the hinge plate having a forward end and a rearward end. The hinge plate has a blade position lever opening formed therein. The hinge plate also has a plurality of spaced-apart notches formed in its rearward end. The blade is secured to the hinge plate in conventional fashion so as to be positioned forwardly thereof. A blade position lever is selectively pivotally movably mounted on a blade position lever bracket which is operatively secured to the hinge plate with the lower end of the lever extending downwardly through one of the notches in the hinge plate and through the blade position lever opening formed in the first plate. The blade position lever is selectively movably between locked and unlocked positions and is normally yieldably maintained in its locked position. An electrically driven winch mechanism is operatively mounted on the mounting frame and is operatively connected to the hinge plate for selectively moving the hinge plate and the blade to various angular positions with respect to the mounting frame and the ATV when the blade position lever is in its unlocked position. The blade position lever is automatically moved to its unlocked position by a linkage which operatively engages the underside of the ATV when the forward end of the mounting frame and blade have been moved upwardly to a predetermined position. The blade position lever returns to its locked position when the forward end of the mounting frame and blade have been lowered a predetermined distance from its raised position.

It is therefore a principal object of the invention to provide an improved blade attachment for an all-terrain vehicle.

A further object of the invention is to provide a pivoting blade attachment for an all-terrain vehicle with the blade being able to be pivoted by an electric winch mechanism when the blade has been raised to its uppermost position.

A further object of the invention is to provide a pivoting blade attachment for an ATV or off-road vehicle which enables the blade to be pivoted to various angular positions by an electric winch means.

Yet another object of the invention is to provide an electrically operated winch which selectively angles a blade on an ATV without the necessity of the operator of the ATV dismounting from the ATV and manually pivoting the blade.

Yet another object of the invention is to provide a pivoting blade attachment for an ATV or off-road vehicle which enables the blade to be pivoted to various angular positions by an electric winch means which is operatively connected to the blade by a "slip-clutch" means so that the blade is hand-adjustably angled at any time.

These and other objects will be apparent to those skilled in the art.

DESCRIPTION OF THE PREFERRED EMBODIMENT

Figure 1:
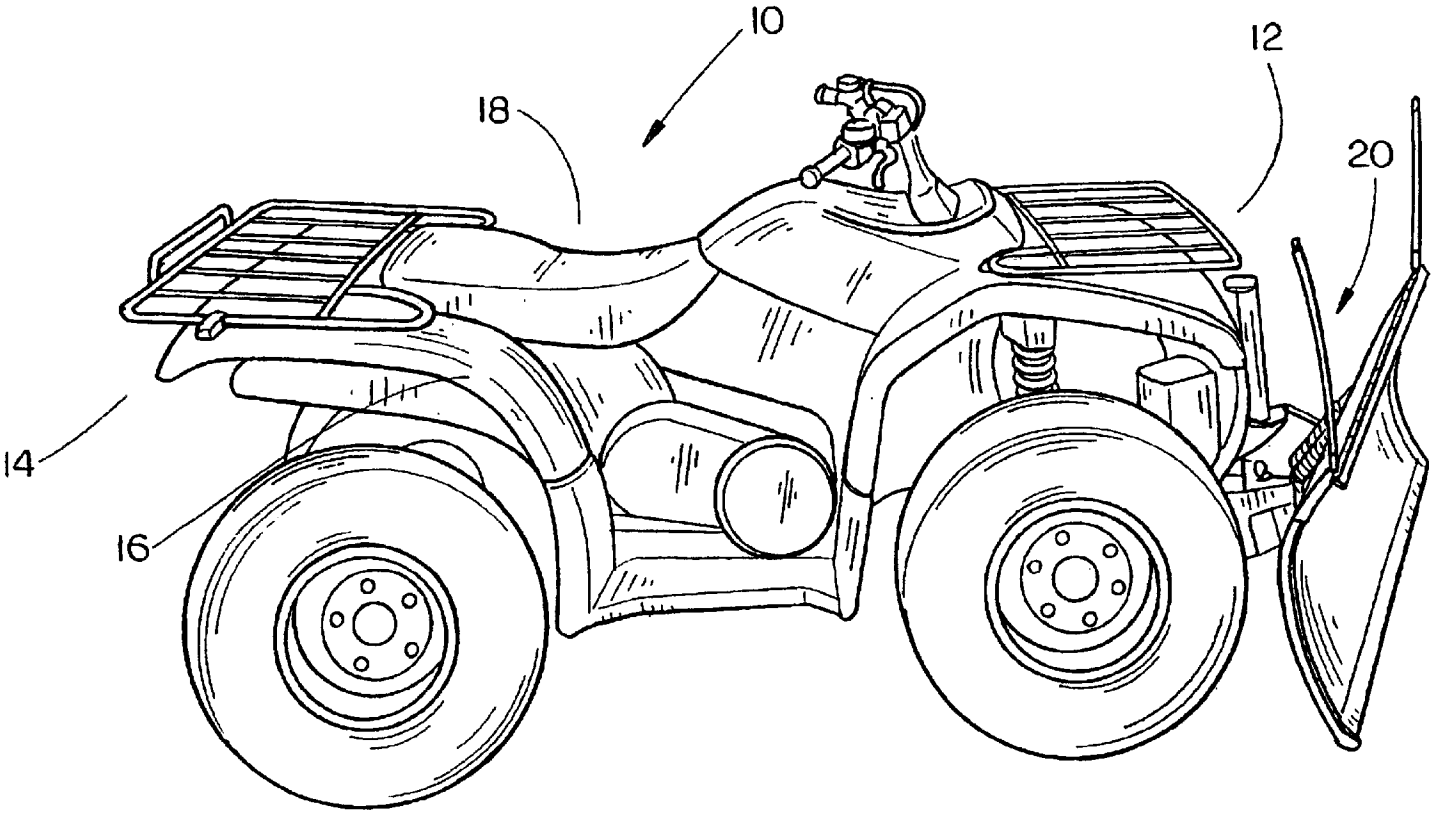
FIG. 1 is a perspective view of an ATV having a blade mounted thereon.
Figure 2:
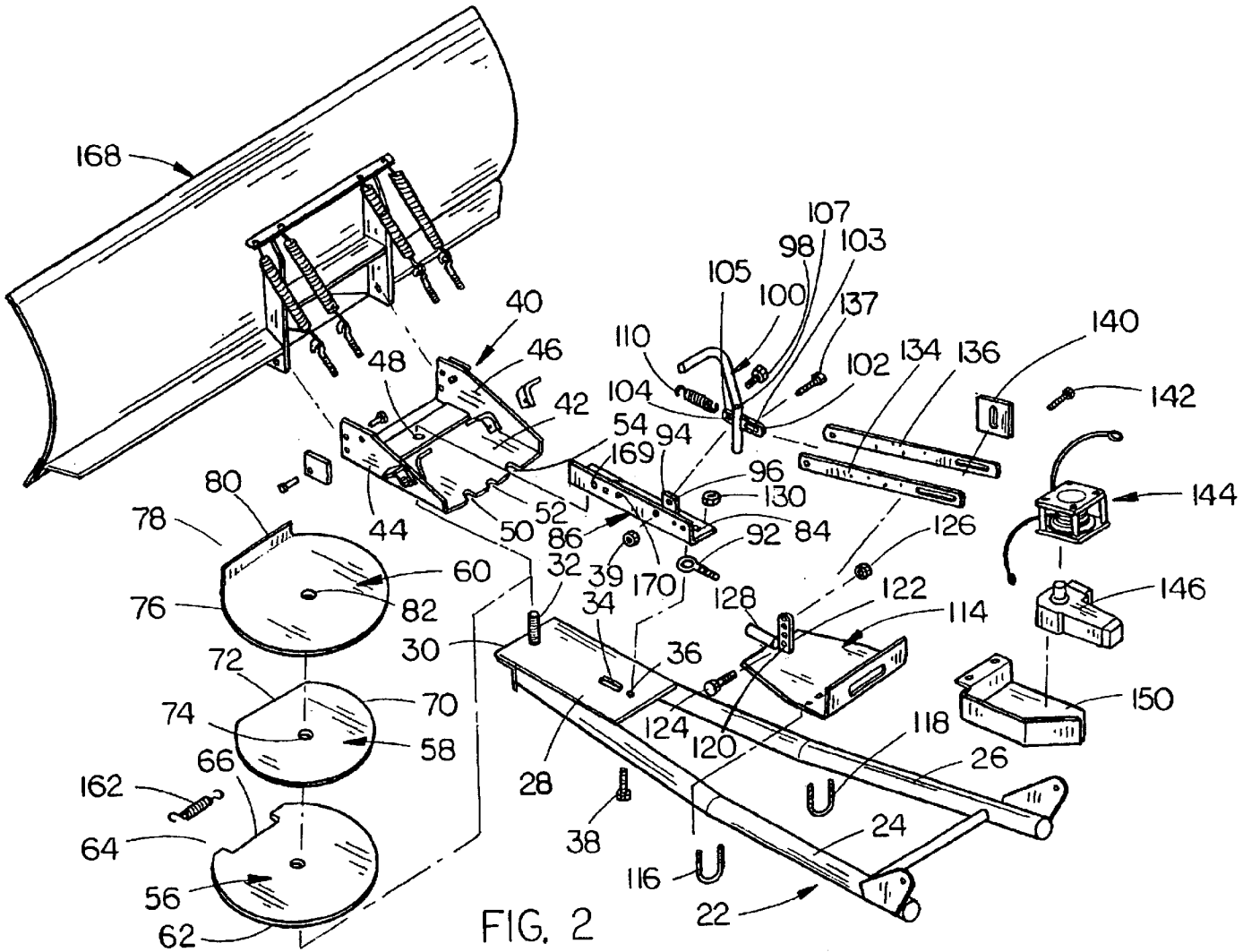
FIG. 2 is an exploded perspective view of the means for mounting the blade on the ATV and the means for pivotally moving the blade to various positions with respect to the ATV.
Figure 3:
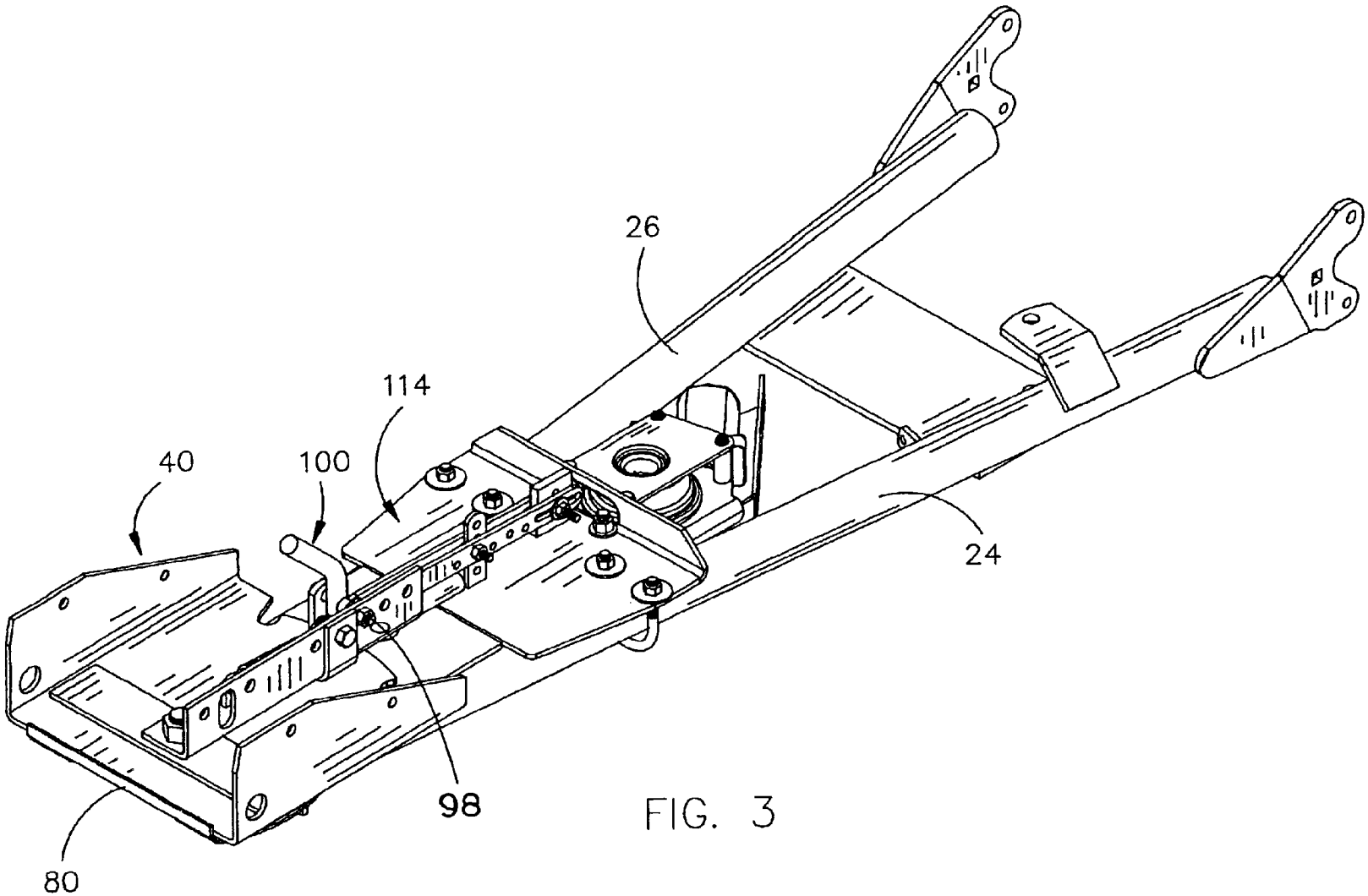
FIG. 3 is a perspective view of the means for mounting the blade on the ATV and the means for pivotally moving the blade to various positions with respect to the ATV.
Figure 4:
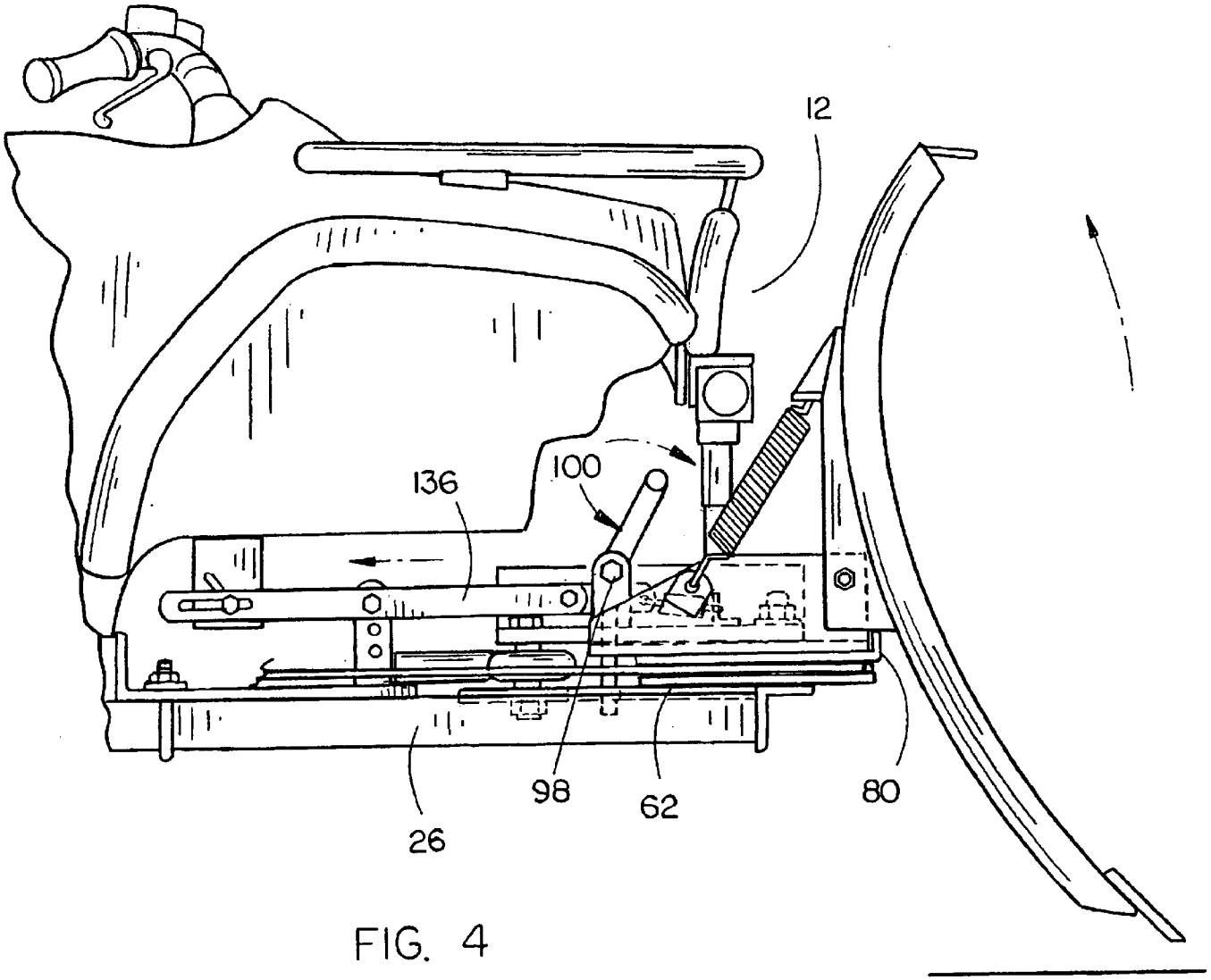
FIG. 4 is a partial side view illustrating the means by which the blade position lever is automatically unlocked as the blade is moved upwardly with respect to the ATV.

The numeral 10 refers generally to an off-road vehicle such as an all-terrain vehicle (ATV), which may be 2-wheel drive or 4-wheel drive. ATV 10 includes a forward end 12, rearward end 14, a right side 16, and a left side 18. The blade attachment of this invention is referred to generally by the reference numeral 20. Attachment 20 includes a push tube assembly 22 comprising push tubes 24, 26 which have their rearward ends pivotally secured to the frame of the ATV by a pin or pins (not shown) in conventional fashion. Support plate 28 is welded or otherwise secured to the forward ends of push tubes 24, 26 and has its forward end 30 positioned forwardly of the forward ends of push tubes 24, 26. Threaded bolt or stud 32 extends upwardly from the forward end of plate 28, as seen in FIG. 2. Plate 28 has a longitudinally extending blade position lever slot or opening 34 formed therein forwardly of the rearward end thereof. Plate 28 also has an opening 36 formed therein rearwardly of slot 34 which is adapted to receive bolt 38 extending upwardly therethrough which is adapted to threadably receive nut 130.

The reference numeral 40 refers to a hinge plate which is positioned above plate 28 including a base portion 42 and upstanding sides 44, 46. Hinge plate 40 includes an opening 48 formed in base portion 42 which is adapted to receive bolt 32 extending upwardly therethrough to enable hinge plate 40 to pivotally move with respect to plate 28. The rearward end of base portion 42 has a plurality of slots or notches formed therein which will be referred to as slots 50, 52 and 54. Any number of slots may be utilized but it is preferred that there be at least a center slot 52, a left slot 50 and a right slot 54.

Plates 56, 58 and 60 are positioned between support plate 28 and base portion 42 of plate 40 as will now be described. Plate 56 will be referred to as a bottom plate and includes an arcuate peripheral surface 62 extending from its forward end 64 which includes a cutout portion 66. Bottom plate 56 has an opening 68 formed therein which receives the bolt 32 extending upwardly therethrough. Plate 58 will be referred to as a mid-plate which includes an arcuate peripheral surface 70 extending from forward end 72. Mid plate 58 has an opening 74 formed therein which receives the bolt 32 extending upwardly therethrough. Plate 60 will be referred to as a top plate which includes an arcuate peripheral surface 76 extending from forward end 78. Plate 60 includes an opening 82 through which bolt 32 extends. As seen, the forward end 78 of top plate 60 has an upwardly extending lip or shoulder 80 which engages the forward end of base portion 42 of hinge plate 40 so that rotation of top plate 60 will cause hinge plate 40 to be pivoted or rotated therewith when in its unlocked position, as will be described in greater detail hereinafter. The plates 56, 58 and 60 are welded together so that they move as a unit.

Figure 5:
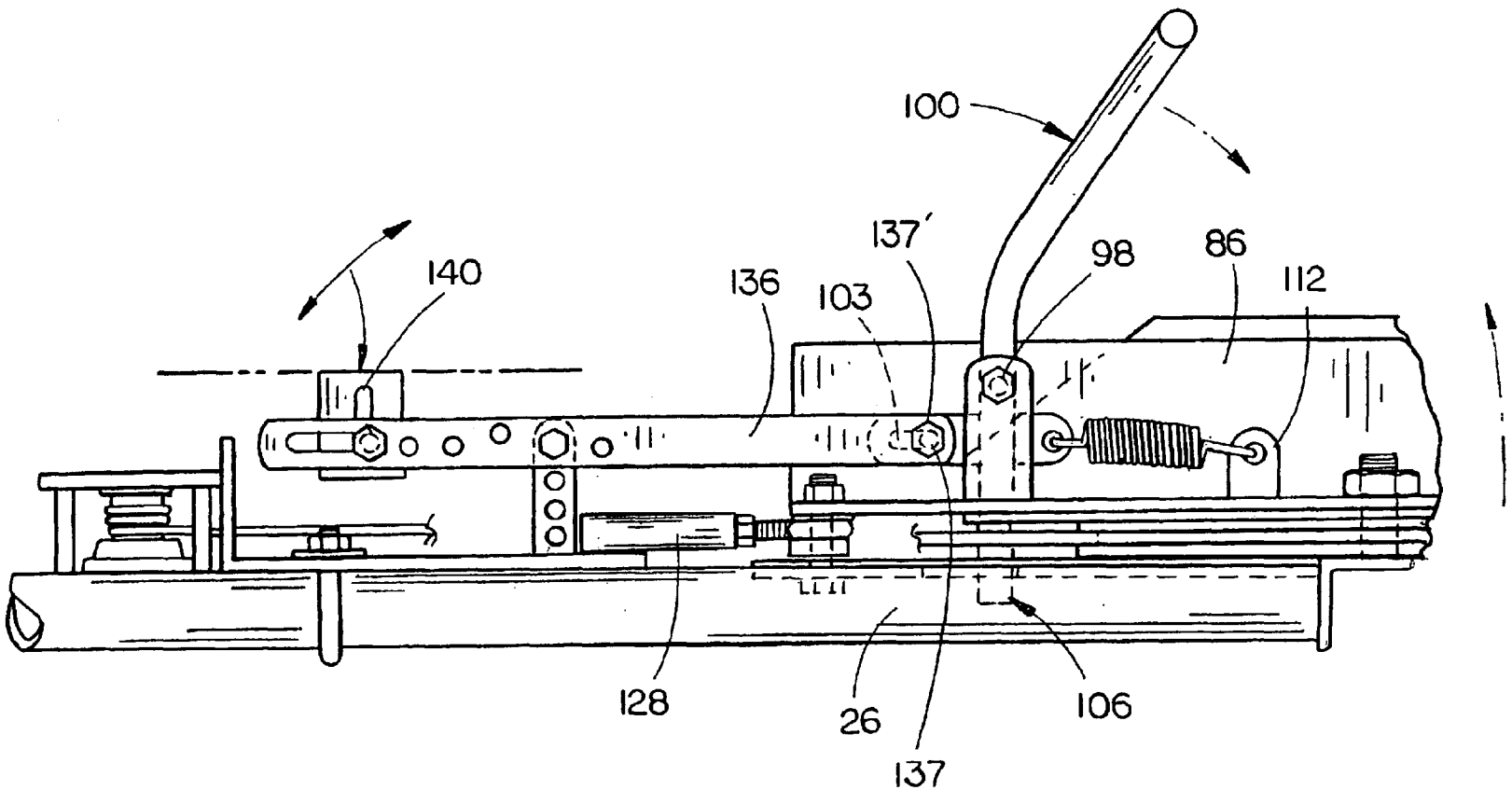
FIG. 5 is a view similar to FIG. 3 but which shows the mechanism in somewhat enlarged detail.
Figure 6:
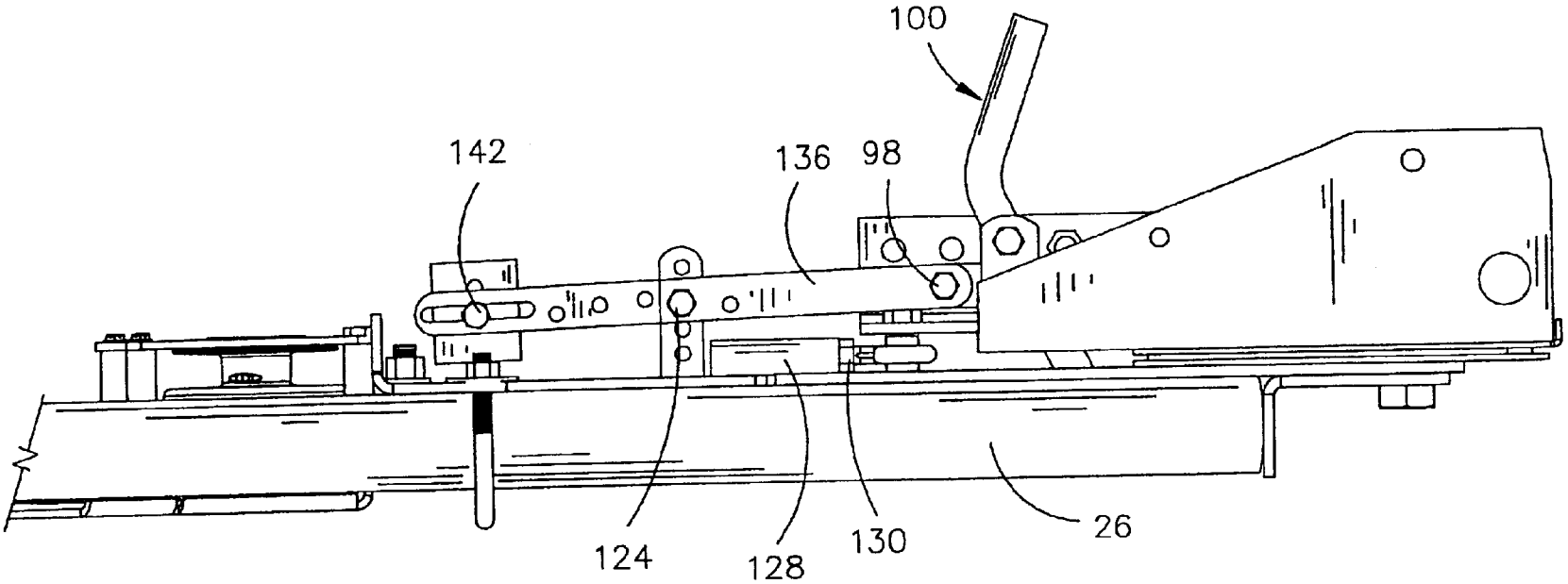
FIG. 6 is a partial side view similar to FIG. 5 except that the linkage has moved the blade position lever to its unlocked position.

Bolt 38 extends upwardly through opening 36 in plate 28 and through opening 84 in blade position lever bracket 86. Eyebolt 92 has its forward "eye" portion positioned beneath bracket 86, as seen in the drawings. Bolt 38 extends through the "eye" portion of eyebolt 92. Bracket 86 has an upstanding ear 94 secured thereto which has an opening 96 formed therein adapted to receive a bolt 98 therein. Blade position lever 100 has oppositely extending tabs or ears 102 and 104 secured thereto. Tab 102 has an elongated slot 103 formed therein while tab 104 has an opening 105 formed therein. Blade position lever 100 has an opening 107 formed therein above tabs 102 and 104. The lower end 106 of lever 100 extends downwardly through a slot formed in the bottom portion of bracket 86. Lever 100 is pivotally secured to ear 94 and bracket 86 by bolt 98 which extends through opening 107 in lever 100. One end of spring 110 is connected to tab 104 with the other end thereof being connected to bracket 112 secured to the forward end of bracket 86 (FIG. 5).

Plate 114 is secured to tubes 24 and 26 by U-bolts 116 and 118, respectively. Plate 114 has an upstanding ear 120 secured to the forward end thereof which has a plurality of openings 122 formed therein adapted to have bolt 124 extending therethrough which receives nut 126. Adjustment tube 128 is secured to plate 114 by welding or the like. The rearward end of eyebolt 92 is adjustably received within the forward end of tube 128. Adjustment nut 130 is threadably mounted on the eyebolt 92 forwardly of the forward end of tube 128 to provide a "fine" adjustment of the plate 114 on the mounting frame 22 when U-bolts 116 and 118 are loosened. Once plate 114 is adjusted, U-bolts 116 and 118 are tightened. Links or bars 134 and 136 are selectively vertically and horizontally secured to ear 120 by pin 124. The forward ends of links 134 and 136 are slidably connected to tab 102 of blade position lever 100 by bolt 137 extending through slot 103 and maintained therein by nut 137'. The rearward ends of links 134 and 136 have an actuator 140 selectively vertically and horizontally secured thereto by bolt 142.

Figure 7:
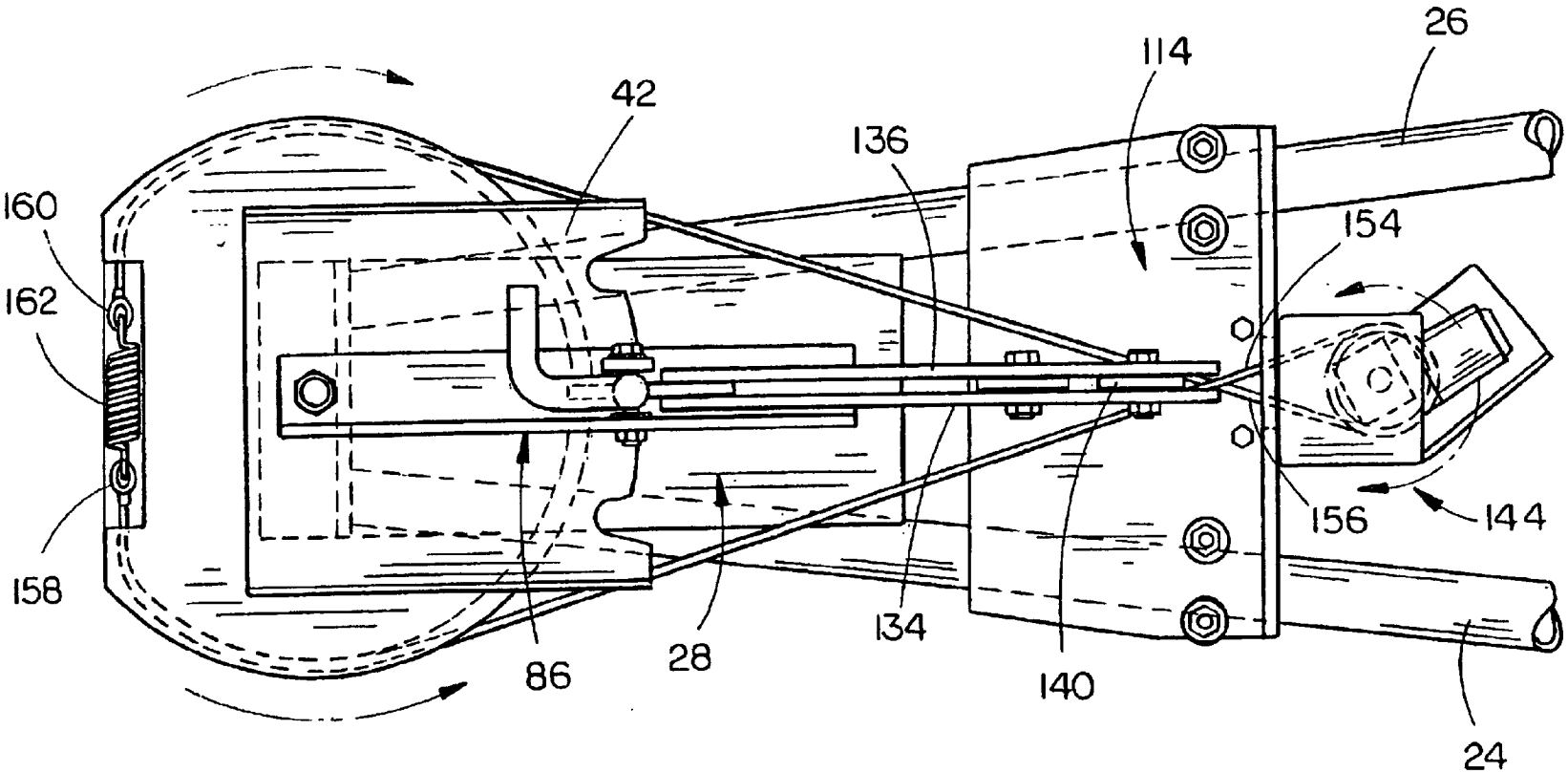
FIG. 7 is a top elevational view of the mechanism for unlocking the blade position lever.
Figure 8:
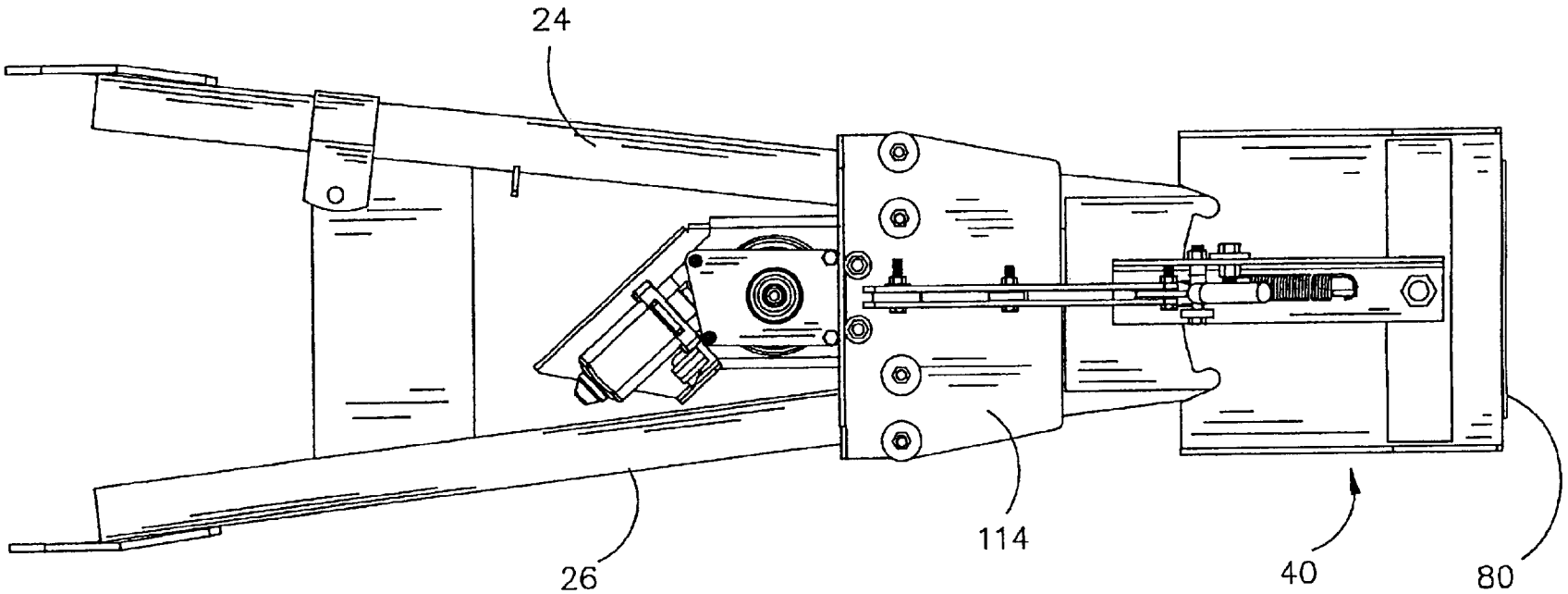
FIG. 8 is a top view of the means for moving the blade to various positions.
Figure 9:
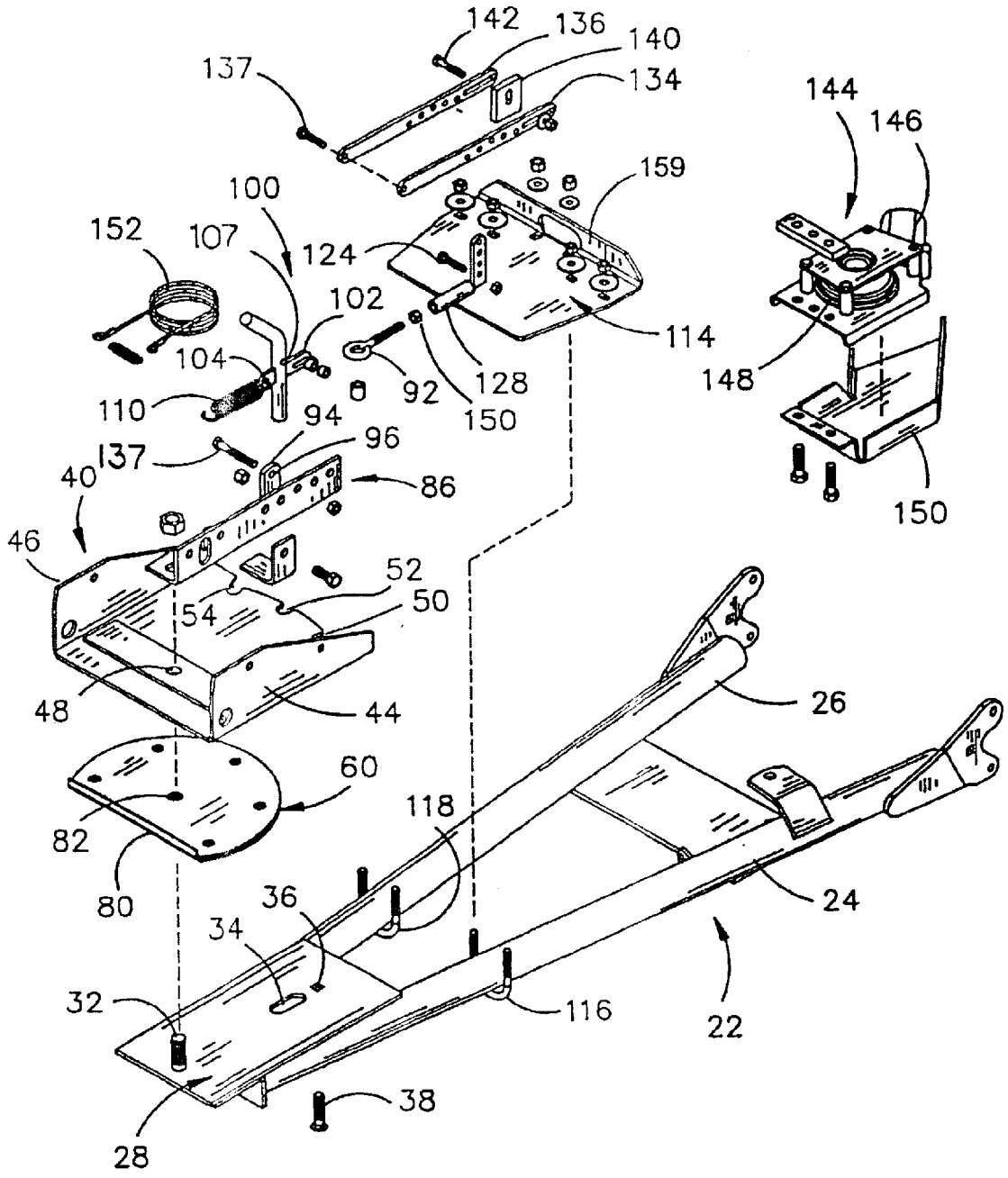
FIG. 9 is a partial exploded perspective view of the invention herein.

An electric winch 144 including a fractional horsepower electric motor 146, driven by the vehicle electrical system, and a winch drum 148 is secured to plate 114, as seen in the drawings. A skid plate 150 is positioned below the winch 144 for protecting the winch 144 from damage. Winch drum 146 has a few wraps of winch cable 152 extending therearound to define cable portions 154 and 156. The cable portions 154 and 156 of 152 extend forwardly from drum 146 through slot 159 formed in plate 114 and are crossed, as seen in FIG. 7. The cable portions 154 and 156 extend around a portion of the arcuate periphery 70 of mid-plate 58 between plates 56 and 60. The ends of cable portions 154 and 156 have eyes 158 and 160 attached thereto, respectively, as seen in FIG. 7. Eyes 158 and 160 are connected together by spring 162 which is positioned forwardly of forward end 72 of plate 58 and within cutout area 66 of plate 58. Spring 162 maintains cable portions 154 and 156 in yieldably frictional engagement with plate 58 and drum 146 so that movement of the cable portions 154 and 156 by the electric motor 146 will cause plate 58 to rotate about bolt 32. Since plates 56, 58 and 60 are welded together, rotation of plate 58 will cause plates 56 and 60 to also rotate. Rotation of plate 60 will cause hinge plate 40 to pivot about bolt 32 due to the engagement of lip 80 with the forward end of hinge plate 40.

Bracket 86 has a slot 169 and holes 170 to receive a winch hook or manual lift handle or electric blade lift components to raise and lower the forward end of push tube assembly 22 and blade 168. Blade 168 is connected to hinge plate 40 in conventional fashion whereby blade 168 moves with hinge plate 40 about the vertical axis defined by bolt 32.

When it is desired to change the angle of the blade 168 with respect to the off-road vehicle such as an ATV 10, the blade 168 is raised from ground engagement by the lift handle, linear actuator, winch, etc., which causes the push tube assembly 22 to pivotally move upwardly about its rearward end. As the push tube assembly 22 and the blade 168 are raised with respect to the ATV 10, the selectively adjustable actuator 140 will come into contact with a selectable portion of the underside of the ATV 10, as illustrated in FIG. 5. Continued upward movement of the push tube assembly 22 and the blade 168 will cause the links 134 and 136 to move downwardly, as indicated by the arrows in FIG.

4, due to the pivotal connection of the links 134 and 136 to the plate 114. As the links 134 and 136 move downwardly, the links 134 and 136 exert an upward force on the lever 100 which causes the lever 100 to pivot about bolt 98 which causes the lower end of the lever 100 to move rearwardly out of engagement with the notches or slots 50, 52 and 54, depending upon which slot it is positioned in, so that hinge plate 40 and the blade 168 are not locked into position. At that time, the winch 144 is actuated in the desired direction so that end cable portion 154 is moved rearwardly while the other cable portion 156 is moved forwardly or vice versa. Movement of the cable portions 154 and 156 by the winch 144 causes the plates 56, 58 and 60 to be rotated which causes the hinge plate 40 to also be rotated or pivotally moved with respect to the push tube assembly 22 about the bolt 32. The spring 162 exerts tension on the cable portions 154 and 156 to maintain the cable portions 154 and 156 in frictional engagement with the periphery of plate 58 and drum 146. The tension on the cable portions 154 and 156 may also be adjusted by loosening the U-bolts 116 and 118 and then threadably rotating nut 130 on eyebolt 92 so that plate 114 is moved with respect to the push tube assembly 22. When the plate 114 has been moved to a position wherein the proper tension of cable portions 154 and 156 is achieved, the U-bolts 116 and 118 are then tightened.

When the blade has been moved to the desired angle, the push tube assembly 22 and the blade 168 are then lowered somewhat so that the actuator 140 moves out of engagement with the underside of the ATV so that spring 110 urges the lower end of lever 100 towards the rearward end of the hinge plate 40 and the notches or slots formed therein. The winch 144 may then be actuated to properly align the lower end of the lever 100 with the desired slot 50, 52 or 54 so that the lever 100 will lock the hinge plate and the blade into its desired angular position with respect to the ATV.

The wrapping of a few loops of the winch cable around the drum of the winch 144 provides a "slip clutch" attachment of the cable to the winch drum so that if the lever 100 is not perfectly received within one of the slots 50, 52 and 54, the blade, when striking an obstruction, will not impart a direct stress onto the winch. Further, should the winch 144 become inoperative for one reason or another, the operator may manually pivot the blade 168 since the cable may slip on the drum without causing the drum to rotate which would be resisted by the gear drive mechanism of the winch, therefore also adding an additional protection to the rotating winch assembly should the blade come into contact with an obstruction causing the blade to rotate until locked without causing damage to the winch assembly.

It can therefore be seen that a novel apparatus has been provided which enables a blade to be pivotally moved between its various angular positions with respect to the ATV without the need of the operator dismounting from the ATV.

Thus it can be seen that the invention accomplishes at least all of its stated objectives.

I claim:

1. A blade attachment for an off-road vehicle having a forward end, a rearward end, a right side, a left side, and an underside, comprising in combination:

a mounting frame having rearward and forward ends;

said rearward end of said mounting frame being pivotally connected, about a horizontal axis, to said vehicle and extending forwardly therefrom so that its said forward end is positioned forwardly of said forward end of said vehicle;

said forward end of said mounting frame being selectively movable between raised and lowered positions;

a blade having a right end and a left end;

said blade being selectively, pivotally secured to said forward end of said mounting frame about a single vertical axis at a position generally intermediate said right end and said left end of said blade;

an electrically driven motor operatively mounted on said mounting frame;

said electrically driven motor being operatively connected to said blade so as to selectively pivotally move said blade between selected angular positions with respect to said mounting frame and the vehicle.

2. The combination of claim 1 wherein said motor is powered by the vehicle electrical system.

3. The combination of claim 1 wherein said motor is operatively connected to said blade by a clutch.

4. The combination of claim 3 wherein said clutch comprises a slip clutch.

5. The combination of claim 1 wherein said motor is a fractional horsepower motor.

6. The combination of claim 1 including a connection means for selectively adjustably connecting said motor to said blade.

7. The combination of claim 1 wherein said vehicle is an all-terrain vehicle.

8. A blade attachment for an off-road vehicle having a forward end, a rearward end, a right side, a left side, and an underside, comprising in combination:

a mounting frame having rearward and forward ends;

said rearward end of said mounting frame being pivotally connected, about a horizontal axis, to said vehicle and extending forwardly therefrom so that its said forward end is positioned forwardly of said forward end of said vehicle;

said forward end of said mounting frame being selectively movable between raised and lowered positions;

a first plate means secured to said forward end of said mounting frame;

a hinge plate selectively movably positioned on said first plate about a vertical axis and having a forward end and a rearward end;

said hinge plate having a blade position lever opening formed therein;

said hinge plate having a plurality of spaced-apart notches formed in its said rearward end;

a blade secured to said hinge plate;

a blade position lever operatively pivotally movably mounted on said hinge plate which extends downwardly therefrom through one of said notches and through said blade position lever opening;

said blade position lever being selectively movable between locked and unlocked positions;

said blade position lever normally being in its said locked position;

and an electrically driven motor operatively mounted on said mounting frame;

said motor being operatively connected to said hinge plate for moving said hinge plate and said blade to various angular positions with respect to said mounting frame and the vehicle when said blade position lever is not in its said locked position.

9. The combination of claim 8 wherein the motor has a drive pulley associated therewith; a cable wound upon said drive pulley and having first and second ends; said first and second ends of said cable being operatively secured to said hinge plate.

10. The combination of claim 9 wherein said cable is wound upon said drive pulley in such a fashion to permit said cable to slip upon said drive pulley should said hinge plate and blade be physically moved without said motor being actuated.

11. The combination of claim 10 wherein said first and second ends are secured to a driven plate which is positioned between said hinge plate and said first plate; said driven plate being operatively attached to said hinge plate for movement therewith.

12. The combination of claim 11 wherein said first and second ends of said cable are resiliently connected together.

13. The combination of claim 8 wherein said motor is powered by the vehicle electrical system.

14. The combination of claim 8 wherein said blade position lever is in an unlocked position when said forward end of said mounting frame is in its raised position.

15. The combination of claim 14 wherein said locking mechanism is in a locked position when said forward end of said mounting frame has been lowered a predetermined distance from its said raised position.

16. The combination of claim 14 wherein a linkage is operatively secured to said blade position lever for moving said blade position lever to its unlocked position so that said motor may pivotally move said hinge plate and said blade.

17. The combination of claim 16 wherein said linkage is engageable with the vehicle when said forward end of said mounting frame is in its raised position to move said blade position lever to its said unlocked position.

18. The combination of claim 16 wherein an actuator is operatively secured to said linkage which is engageable with the vehicle when said mounting frame has been moved to its said raised position.

19. The combination of claim 16 wherein said actuator is selectively adjustably mounted on said linkage.

20. The combination of claim 8 wherein said motor is a fractional horsepower motor.

21. The combination of claim 8 wherein a spring is operatively connected to said blade position lever to urge said blade position lever towards its said locked position.

22. The combination of claim 8 wherein said motor is selectively adjustably connected to said mounting frame.

23. The combination of claim 8 wherein said motor is selectively adjustably connected to said hinge plate.

24. The combination of claim 8 wherein said vehicle is an all-terrain vehicle.

25. The combination of claim 8 wherein said vehicle is a single passenger vehicle.

26. A blade attachment for an off-road vehicle having a forward end, a rearward end, a right side, a left side, and an underside, comprising in combination:

a mounting frame having rearward and forward ends;

said rearward end of said mounting frame being pivotally connected, about a horizontal axis, to said vehicle and extending forwardly therefrom so that its said forward end is positioned forwardly of said forward end of said vehicle;

said forward end of said mounting frame being selectively movable between raised and lowered positions;

a blade having a right end and a left end, selectively pivotally secured about a vertical axis to said forward end of said mounting frame;

an electrically driven motor operatively mounted on said mounting frame;

said electrically driven motor being operatively connected to said blade so as to selectively pivotally move said blade between selected angular positions with respect to said mounting frame and the vehicle;

a locking mechanism for selectively locking said blade in said selected angular positions.

27. The combination of claim 26 wherein said locking mechanism is in an unlocked position when said forward end of said mounting frame is in its said raised position.

28. The combination of claim 27 wherein said locking mechanism is in a locked position when said forward end of said mounting frame has been lowered a predetermined distance from its said raised position.

29. The combination of claim 28 wherein said locking mechanism includes a locking pin, movable between locked and unlocked positions, and wherein a linkage is operatively secured to said locking pin for moving said locking pin to its unlocked position so that said motor may pivotally move said blade to one of its selected angular positions.

30. The combination of claim 29 wherein said linkage is engageable with the vehicle when said forward end of said mounting frame is in its raised position to move said locking pin to its said unlocked position.

31. The combination of claim 30 wherein a spring is operatively connected to said locking pin to urge said locking pin towards its said locked position.

32. The combination of claim 30 wherein an actuator is operatively mounted on said linkage which is engageable with the vehicle when said mounting frame has been moved to is said raised position.

33. The combination of claim 32 wherein said actuator is selectively adjustably mounted on said linkage.

* * * * *